US008919015B2

(12) United States Patent
Holt et al.

(10) Patent No.: US 8,919,015 B2
(45) Date of Patent: Dec. 30, 2014

(54) ARTICLE OF FOOTWEAR HAVING A SOLE STRUCTURE WITH A FLEXIBLE GROOVE

(75) Inventors: Scott C. Holt, Portland, OR (US); Lee D. Peyton, Tigard, OR (US); Eric S. Schindler, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 412 days.

(21) Appl. No.: 13/414,857

(22) Filed: Mar. 8, 2012

(65) Prior Publication Data

US 2013/0232821 A1 Sep. 12, 2013

(51) Int. Cl.
*A43B 13/00* (2006.01)

(52) U.S. Cl.
USPC ..... 36/102; 36/25 R; 36/114

(58) Field of Classification Search
CPC ..... A43B 13/00; A43B 13/141; A43B 13/14
USPC ..... 36/25 R, 30 R, 31, 102, 114
See application file for complete search history.

(56) References Cited

U.S. PATENT DOCUMENTS

| | | | | |
|---|---|---|---|---|
| 500,385 | A | 6/1893 | Hall | |
| 2,155,166 | A | 4/1939 | Kraft | |
| 2,188,168 | A | 1/1940 | Winkel | |
| 2,224,590 | A | 12/1940 | Odilon Boivin | |
| 3,087,261 | A | 4/1963 | Russell | |
| 3,683,431 | A | 8/1972 | Pennel et al. | |
| 4,059,910 | A | 11/1977 | Bryden et al. | |
| 4,183,156 | A | 1/1980 | Rudy | |
| 4,219,945 | A | 9/1980 | Rudy | |
| 4,241,524 | A | 12/1980 | Sink | |
| 4,265,032 | A | 5/1981 | Levine | |
| 4,287,250 | A | 9/1981 | Rudy | |
| 4,302,892 | A | 12/1981 | Adamik | |
| 4,309,831 | A | 1/1982 | Pritt | |
| 4,309,832 | A | 1/1982 | Hunt | |
| 4,340,626 | A | 7/1982 | Rudy | |
| 4,638,577 | A | 1/1987 | Riggs | |
| D288,027 | S | 2/1987 | Tonkel | |
| D294,537 | S | 3/1988 | Le | |
| D294,653 | S | 3/1988 | Le | |
| 4,906,502 | A | 3/1990 | Rudy | |
| 4,908,964 | A | 3/1990 | Deem | |
| 4,914,838 | A * | 4/1990 | Ihlenburg | 36/114 |

(Continued)

FOREIGN PATENT DOCUMENTS

| | | |
|---|---|---|
| EP | 1002475 | 5/2000 |
| GB | 2340378 | 2/2000 |

(Continued)

OTHER PUBLICATIONS

International Search Report and the Written Opinion mailed Jul. 30, 2013 in PCT Application No. PCT/US2013/028999.

*Primary Examiner* — Marie Bays
(74) *Attorney, Agent, or Firm* — Plumsea Law Group, LLC

(57) ABSTRACT

An article of footwear includes an upper and a sole structure secured to the upper. The sole structure includes a midsole, an outsole, and at least one groove. The groove includes a macro groove and at least one micro groove located within the macro groove. The macro groove may be formed by an indentation or area of reduced thickness in the sole structure. The micro groove may be formed by an indentation or area of reduced thickness in a surface of the macro groove.

34 Claims, 15 Drawing Sheets

(56) References Cited

U.S. PATENT DOCUMENTS

| | | | | |
|---|---|---|---|---|
| 4,936,029 | A | 6/1990 | Rudy | |
| 5,042,176 | A | 8/1991 | Rudy | |
| 5,083,361 | A | 1/1992 | Rudy | |
| 5,425,184 | A | 6/1995 | Lyden et al. | |
| 5,572,804 | A | 11/1996 | Skaja et al. | |
| D378,472 | S | 3/1997 | Bramani | |
| 5,625,964 | A | 5/1997 | Lyden et al. | |
| 5,713,141 | A | 2/1998 | Mitchell et al. | |
| D396,342 | S | 7/1998 | Foxen et al. | |
| 5,784,808 | A | 7/1998 | Hockerson | |
| 5,915,820 | A | 6/1999 | Kraeuter et al. | |
| 5,952,065 | A | 9/1999 | Mitchell et al. | |
| 5,976,451 | A | 11/1999 | Skaja et al. | |
| 5,987,781 | A | 11/1999 | Pavesi et al. | |
| 5,993,585 | A | 11/1999 | Goodwin et al. | |
| 6,013,340 | A | 1/2000 | Bonk et al. | |
| 6,029,962 | A | 2/2000 | Shorten et al. | |
| D421,832 | S | 3/2000 | Loveder | |
| 6,065,230 | A | 5/2000 | James | |
| 6,079,126 | A | 6/2000 | Olszewski | |
| 6,082,023 | A * | 7/2000 | Dalton | 36/28 |
| 6,082,025 | A | 7/2000 | Bonk et al. | |
| 6,098,313 | A | 8/2000 | Skaja | |
| 6,115,945 | A | 9/2000 | Ellis et al. | |
| 6,119,371 | A | 9/2000 | Goodwin et al. | |
| 6,127,026 | A | 10/2000 | Bonk et al. | |
| 6,178,663 | B1 | 1/2001 | Schoesler | |
| 6,189,239 | B1 * | 2/2001 | Gasparovic et al. | 36/102 |
| 6,203,868 | B1 | 3/2001 | Bonk et al. | |
| 6,205,682 | B1 | 3/2001 | Park | |
| 6,321,465 | B1 | 11/2001 | Bonk et al. | |
| 6,487,795 | B1 | 12/2002 | Ellis, III | |
| 6,900,755 | B2 | 5/2005 | Richardson et al. | |
| D512,818 | S | 12/2005 | Mitani et al. | |
| 7,141,131 | B2 | 11/2006 | Foxen et al. | |
| 7,143,529 | B2 * | 12/2006 | Robinson et al. | 36/127 |
| 7,168,190 | B1 | 1/2007 | Gillespie | |
| 7,325,336 | B2 * | 2/2008 | Yamashita et al. | 36/102 |
| 7,386,946 | B2 | 6/2008 | Goodwin | |
| 7,555,848 | B2 | 7/2009 | Aveni et al. | |
| 7,637,035 | B1 * | 12/2009 | Gillespie | 36/102 |
| 7,665,230 | B2 | 2/2010 | Dojan et al. | |
| 2002/0121031 | A1 | 9/2002 | Smith et al. | |
| 2003/0046830 | A1 | 3/2003 | Ellis, III | |
| 2003/0097767 | A1 | 5/2003 | Perkinson | |
| 2003/0131501 | A1 * | 7/2003 | Erickson et al. | 36/127 |
| 2003/0183324 | A1 | 10/2003 | Tawney et al. | |
| 2005/0076536 | A1 | 4/2005 | Hatfield et al. | |
| 2005/0097777 | A1 | 5/2005 | Goodwin | |
| 2005/0133968 | A1 | 6/2005 | Foxen et al. | |
| 2006/0130361 | A1 * | 6/2006 | Robinson et al. | 36/25 R |
| 2008/0052965 | A1 * | 3/2008 | Sato | 36/103 |
| 2008/0289224 | A1 | 11/2008 | Sink | |
| 2010/0299965 | A1 | 12/2010 | Avar et al. | |
| 2011/0113656 | A1 * | 5/2011 | Sato | 36/30 R |
| 2012/0174433 | A1 * | 7/2012 | Mahoney | 36/28 |
| 2013/0074370 | A1 * | 3/2013 | Park | 36/102 |
| 2013/0247425 | A1 * | 9/2013 | Davis et al. | 36/30 R |

FOREIGN PATENT DOCUMENTS

| | | |
|---|---|---|
| WO | WO9103180 | 3/1991 |
| WO | WO9105491 | 5/1991 |
| WO | WO9111924 | 8/1991 |
| WO | WO9119429 | 12/1991 |
| WO | WO9207483 | 5/1992 |
| WO | WO9403080 | 2/1994 |
| WO | 2009146231 A1 | 12/2009 |

* cited by examiner

ARTICLE OF FOOTWEAR HAVING A SOLE STRUCTURE WITH A FLEXIBLE GROOVE

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., cushion the foot) during walking, running, and other ambulatory activities. The midsole may also include fluid-filled chambers, plates, moderators, or other elements that further attenuate forces, enhance stability, or influence motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

According to one configuration, an article of footwear may include an upper and a sole structure secured to the upper. The sole structure may extend through a length of the footwear and from a lateral side to an opposite medial side of the footwear. The sole structure may define a first surface and an opposite second surface. The first surface may be joined to the upper. The second surface may form a ground-contacting area of the footwear that defines: a macro groove and a plurality of micro grooves. The macro groove may have (a) a length extending from the lateral side and toward the medial side and (b) a depth extending into the sole structure and toward the first surface. The micro grooves may be located within the macro groove and have (a) lengths extending from the lateral side and toward the medial side and (b) depths extending into the sole structure and toward the first surface. The length of the macro groove may be greater than the lengths of the micro grooves, and the depth of the macro groove may be at least three times the depths of the micro grooves.

According to one configuration, an article of footwear may include an upper and a sole structure secured to the upper. The sole structure may have an upper surface and an opposite ground-contacting surface. The ground-contacting surface may define a first indentation and a plurality of second indentations. The first indentation may have a first length and a first depth. The second indentations may be located within the first indentation. Each of the second indentations may have a second length and a second depth, with the first length being greater than the second length, the first depth being at least three times the second depth, and the first depth being at least twenty-five percent of a distance between the upper surface and the ground-contacting surface.

According to a configuration, an article of footwear may include an upper and a sole structure secured to the upper. The sole structure may include a midsole and an outsole. The midsole may include a first surface and a second surface, the first surface being located adjacent to the upper, and the second surface being located opposite the first surface and defining a depression that extends in a direction between opposite sides of the footwear. The outsole may be secured to at least a portion of the second surface, the outsole forming at least a portion of a ground-contacting surface of the footwear. A macro groove may be located at the depression and extend in the direction between the opposite sides of the footwear. The macro groove may form an indentation in the ground-contacting surface. A plurality of micro grooves may be located within the macro groove. The micro grooves may extend in the direction between the opposite sides of the footwear. The micro grooves may form additional indentations in the ground-contacting surface The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of an article of footwear. Although the footwear is disclosed as having a configuration that is suitable for running, concepts associated with the footwear may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the footwear may also be utilized with footwear styles that are generally considered to be non-athletic, including dress shoes, loafers, and sandals. Accordingly, the concepts disclosed herein may be utilized with a variety of footwear styles.

Figure 1:
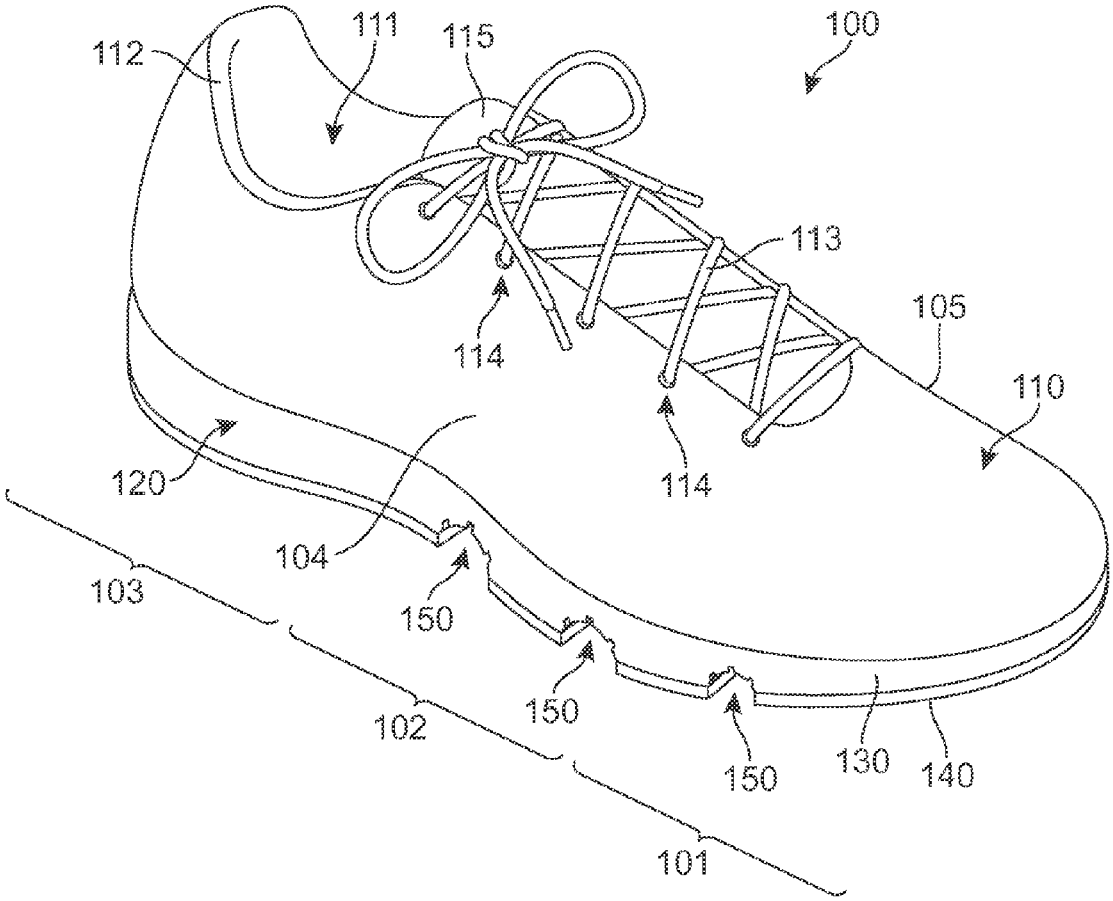
FIG. 1 is a perspective view of an article of footwear.
Figure 2:
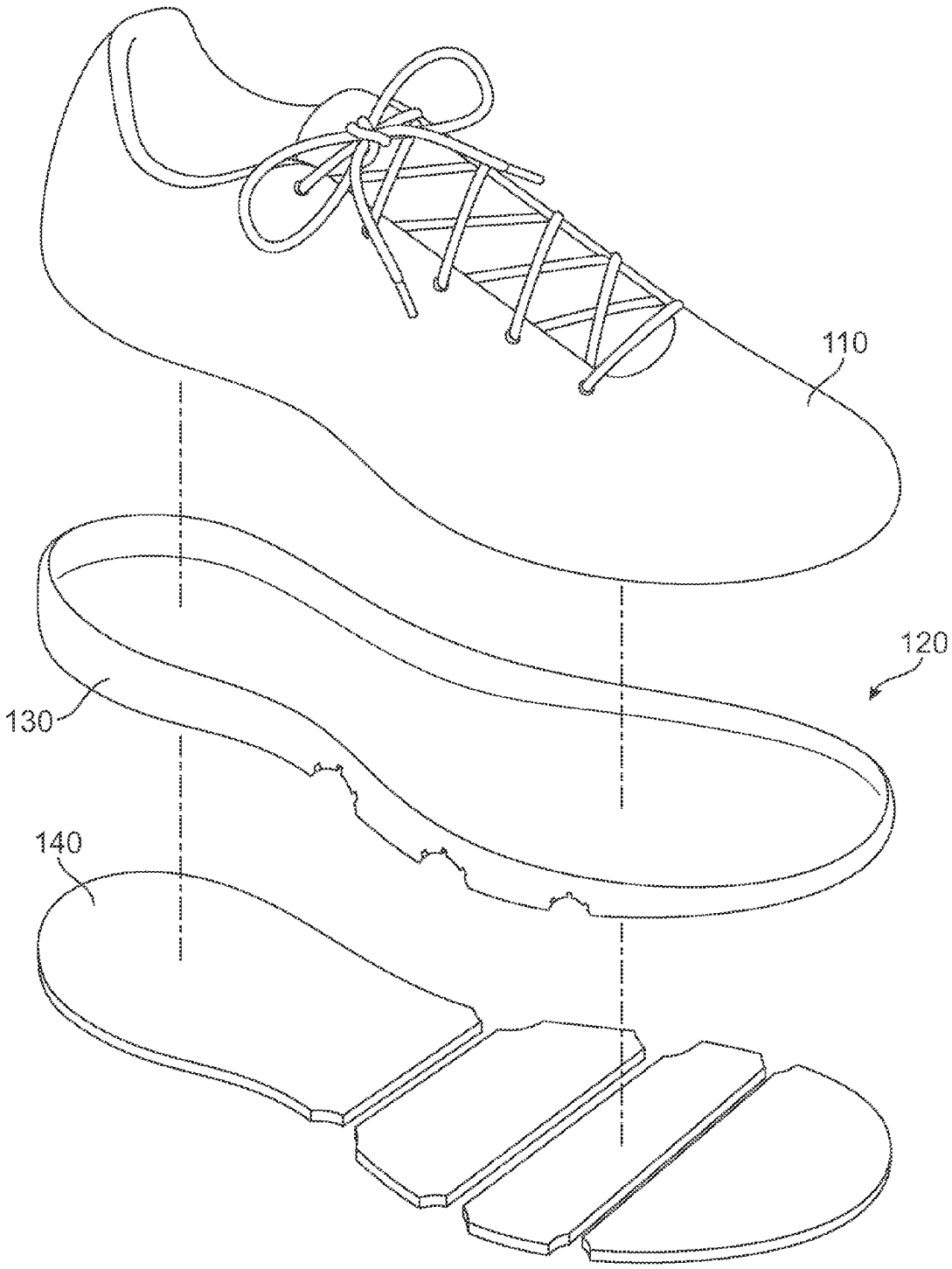
FIG. 2 is an exploded perspective view of the article of footwear.

An article of footwear 100 is depicted in FIGS. 1 and 2 as including an upper 110 and a sole structure 120. Upper 110 provides a comfortable and secure covering for a foot of a wearer. As such, the foot may be located within upper 110 to effectively secure the foot within footwear 100. Sole structure 120 is secured to a lower area of upper 110 and extends between upper 110 and the ground. When the foot is located within upper 110, sole structure 120 extends under the foot to attenuate ground reaction forces (i.e., cushion the foot), provide traction, enhance stability, and influence the motions of the foot, for example.

For reference purposes, footwear 100 may be divided into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of regions 101-103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100, regions 101-103 and sides 104-105 may also be applied to upper 110, sole structure 120, and individual elements thereof.

Upper 110 is depicted as having a substantially conventional configuration formed from a variety of elements (e.g., textiles, polymer sheet layers, polymer foam layers, leather, synthetic leather) that are stitched, bonded, or otherwise joined together to provide a structure for receiving and securing the foot relative to sole structure 120. The various elements of upper 110 define a void 111, which is a generally hollow area of footwear 100 with a shape of the foot, that is intended to receive the foot. As such, upper 110 extends along the lateral side of the foot, along the medial side of the foot, over the foot, around a heel of the foot, and under the foot. Access to void 111 is provided by an ankle opening 112 located in at least heel region 103. A lace 113 extends through various lace apertures 114 and permits the wearer to modify dimensions of upper 110 to accommodate the proportions of the foot. More particularly, lace 113 permits the wearer to tighten upper 110 around the foot, and lace 113 permits the wearer to loosen upper 110 to facilitate entry and removal of the foot from void 111 (i.e., through ankle opening 112). In addition, upper 110 includes a tongue 115 that extends between void 111 and lace 113 to enhance the comfort and adjustability of footwear 100. Accordingly, upper 110 is formed from a variety of elements that form a structure for receiving and securing the foot.

The primary elements of sole structure 120 are a midsole 130 and an outsole 140, as depicted in FIGS. 3-6. Midsole 130 is generally formed from a polymer foam material (e.g., polyurethane or ethylvinylacetate foam) that attenuates ground reaction forces (i.e., cushion the foot) during walking, running, and other ambulatory activities. Although not depicted, midsole 130 may also include fluid-filled chambers, plates, moderators, or other elements that further attenuate forces, enhance stability, or influence the motions of the foot. In another configuration, which will be discussed below, midsole 130 may be primarily formed from a fluid-filled chamber. Although absent in some configurations, outsole 140 is secured to a lower surface of midsole 130 and forms at least a portion of a ground-contacting surface of footwear 100. In order to provide a durable and wear-resistant surface for engaging the ground, outsole 140 may be formed from a rubber material. In addition, outsole 140 may be textured to enhance the traction (i.e., friction) properties between footwear 100 and the ground. Sole structure 120 may further include a sockliner (not shown), which is a compressible member located within void 111 and adjacent a lower surface of the foot to enhance the comfort of footwear 100.

Figure 3:
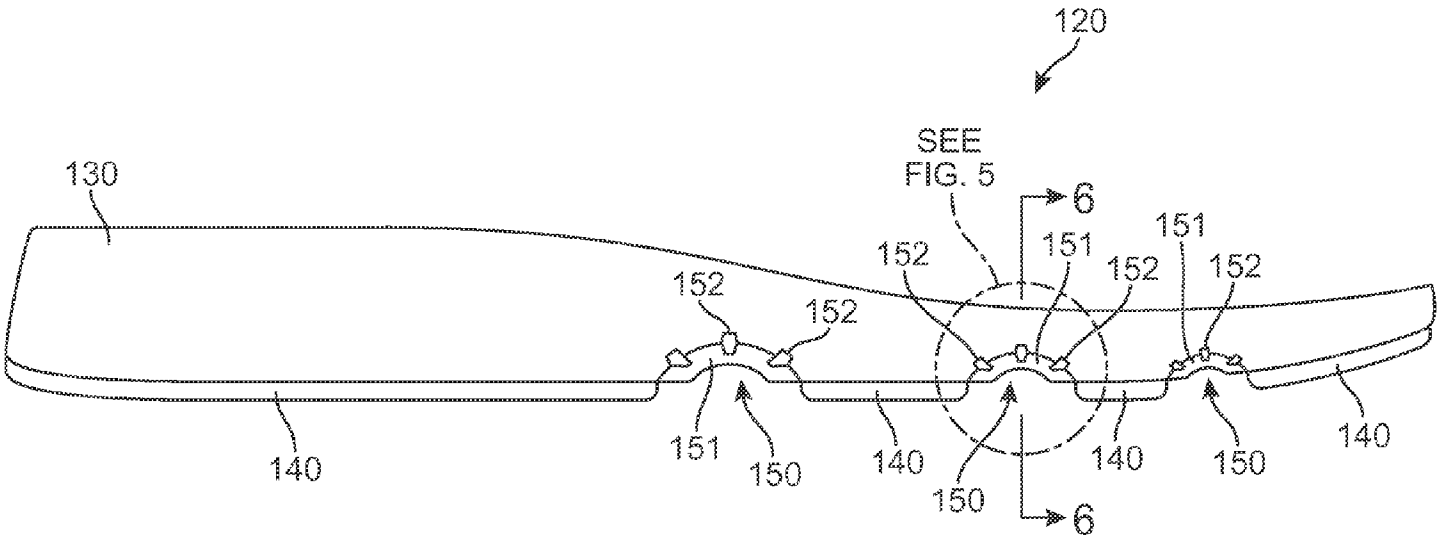
FIG. 3 is a side elevational view of a sole structure from the article of footwear.

Sole structure 120 incorporates various features that provide an advantage of enhancing the ability of footwear 100 to flex, bend, or otherwise deform during walking and running. More particularly, sole structure 120 includes three flexion regions 150 that impart flexibility to specific areas of sole structure 120, as shown in the example of FIG. 3. Flexion regions 150 may, therefore, provide the wearer of footwear 100 with improved comfort or movement when wearing footwear 100 due to an enhanced ability of sole structure 120 to flex and conform with movements of a foot of the wearer. Such an increase in the flexibility of sole structure 120 may be provided while continuing to attenuate ground reaction forces and impart stability.

The various flexion regions 150 may be generally described as an area of reduced thickness in sole structure 120. Given the reduced thickness, flexion regions 150 flex, bend, or otherwise deform with less force than other areas of sole structure 120. Flexion regions 150 are located in various areas of sole structure 120 and may extend between sides 104 and 105. Although the specific locations of each flexion region 150 may vary significantly, the three flexion regions 150 are located (a) in forefoot region 101, (b) at an interface between forefoot region 101 and midfoot region 102, and (c) in midfoot region 102. In this arrangement, flexion regions 150 are located proximal to the joints connecting the metatarsals with the phalanges. That is, flexion regions 150 are located around the joints where the toes join with the rest of the foot. As such, flexion regions 150 may enhance or otherwise facilitate flex in the area of footwear 100 corresponding with the joints connecting the metatarsals with the phalanges.

Figure 4:
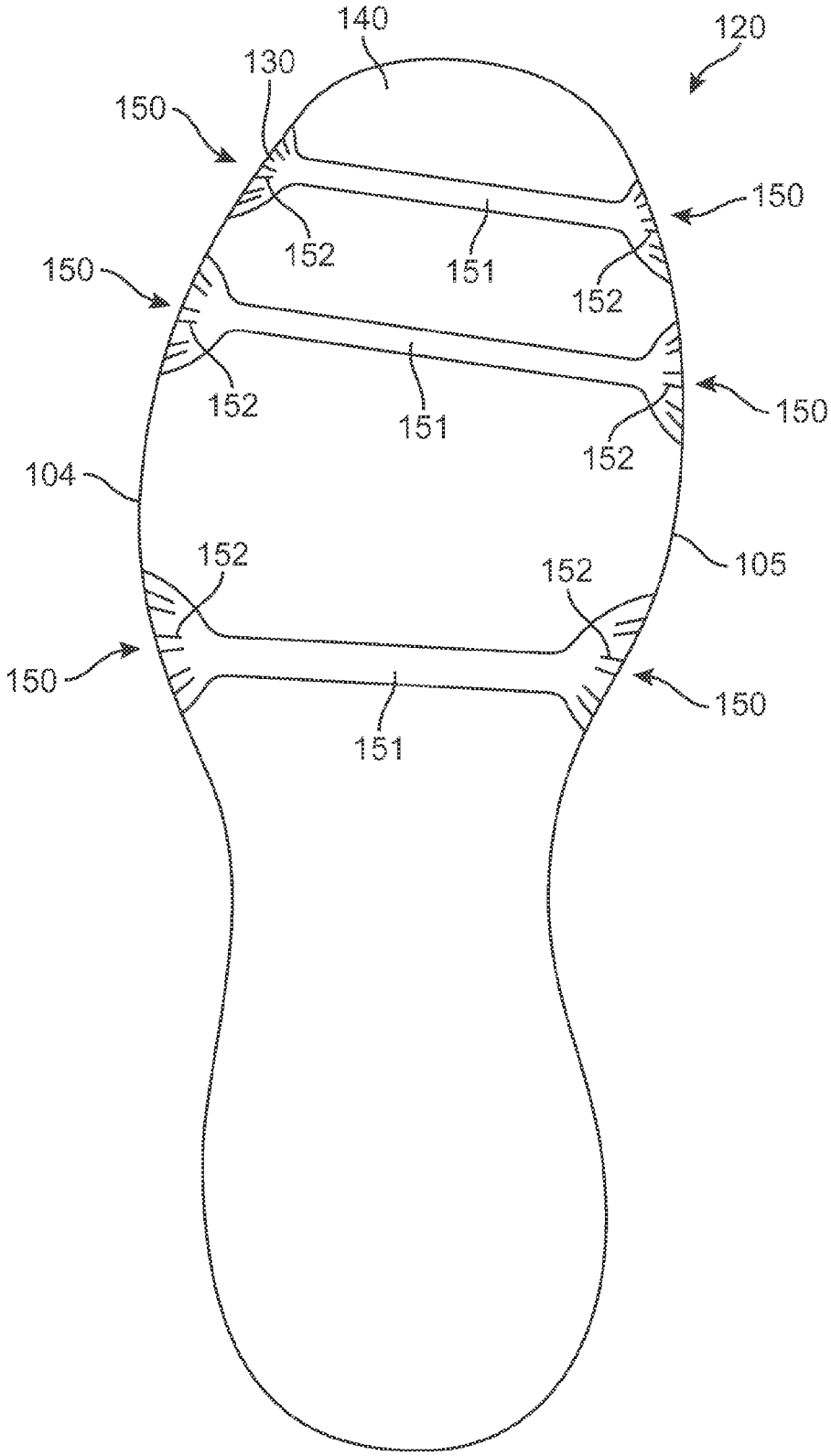
FIG. 4 is a bottom plan view of the sole structure.

Each of flexion regions 150 include a macro groove 151 and a plurality of micro grooves 152. Macro grooves 151 form relatively large indentations in the ground-contacting surface of sole structure 120 and extend entirely across sole structure 120, as shown in FIG. 4. In other configurations, one or more of macro grooves 151 may extend only partially across sole structure 120. For example, portions of macro grooves 151 may be absent from a central area of sole structure 120 (i.e., an area spaced inwards from both of sides 104 and 105).

Micro grooves 152 are located within macro grooves 151 and form relatively small indentations in the ground-contacting surface of sole structure 120. Although micro grooves 152 are located proximal to each of sides 104 and 105 and extend toward the central area of sole structure 120, micro grooves 152 are absent from the central area. As such, the lengths of macro grooves 151 may be greater than the length of micro grooves 152. For example, micro grooves 152 may have a length that is approximately 5-100% of the length of a macro groove 151 in which the micro grooves 152 are located. In another example, individual micro grooves 151 may have a length that is approximately 5-20% of the length of a macro groove 151 in which the micro grooves 152 are located. In other configurations, micro grooves 152 may extend entirely across sole structure 120.

Macro grooves 151 and micro grooves 152 operate cooperatively to enhance the flex of sole structure 120 in the areas of flexion regions 150. More particularly, each of grooves 151 and 152 effectively reduce the thickness of sole structure 120, thereby permitting flexion regions 150 to flex, bend, or otherwise deform with less force than other areas of sole structure 120. Although macro grooves 151 have a depth that forms a majority of the reduced thickness of sole structure 120, the plurality of micro grooves 152 within each of macro grooves 151 have depths that combine to further reduce the thickness of sole structure 120. In combination, therefore, grooves 151 and 152 provide the wearer of footwear 100 with improved comfort or movement when wearing footwear 100 due to an enhanced ability of sole structure 120 to flex and conform with movements of a foot of the wearer.

Figure 5:
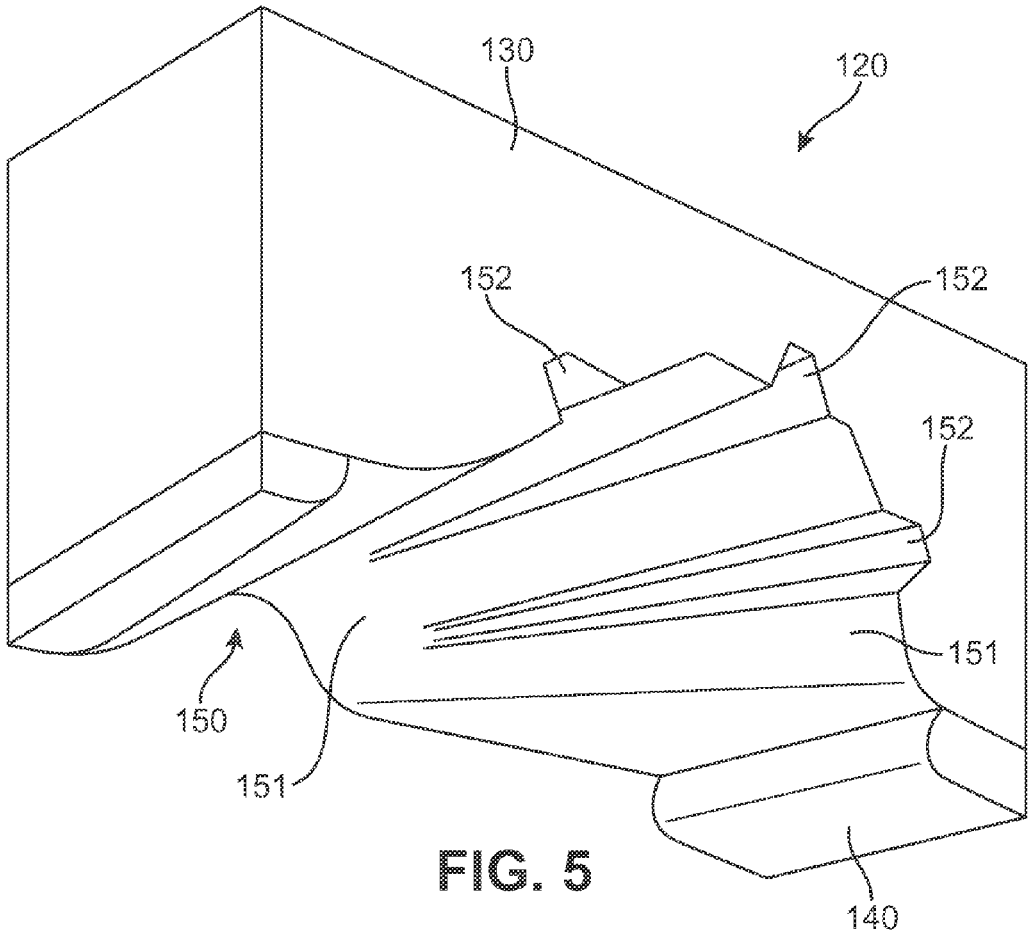
FIG. 5 is a perspective view of a portion of the sole structure, as defined in FIG. 3.
Figure 6:
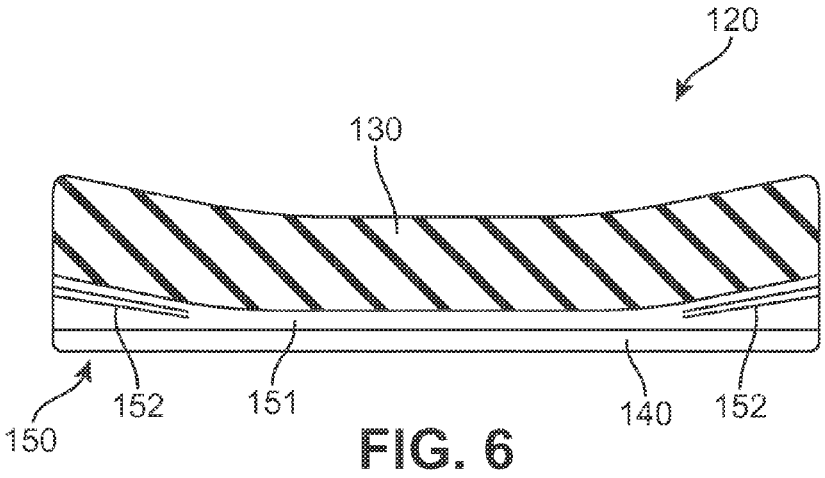
FIG. 6 is a cross-sectional view of the sole structure, as defined in FIG. 3.

The amount of flex provided by flexion regions 150 depends upon various factors, including the depths of macro grooves 151. Referring to FIGS. 5 and 6, one of macro grooves 151 is depicted as having a varying depth. More particularly, the depth is greater at each of sides 104 and 105 than in the central area of sole structure 120. Macro grooves 151 may have, therefore, a tapered aspect where the depth is greatest at sides 104 and 105 and least in the central area of sole structure 120. In order to impart a noticeable or beneficial amount of flex, macro grooves 151 generally have a depth that is at least twenty-five percent of a thickness of sole structure 120. That is, macro grooves 151 form an indentation in sole structure 120 that extends through at least twenty-five percent of a distance between an upper surface of sole structure 120 (i.e., the surface that is secured to upper 110) and the ground-contacting surface. Referring to FIG. 6, for example, the depth of macro groove 151 at lateral side 104 is greater than twenty-five percent of the thickness of sole structure 120 at lateral side 104, and the depth of macro groove 151 in the central area of sole structure 120 is greater than twenty-five percent of the thickness of sole structure 120 in the central area of sole structure 120. In another example, macro grooves 151 have a depth of approximately 3-12 mm.

In addition to the depths of macro grooves 151, the relative depths of micro grooves 152 also affect the amount of flex provided by flexion regions 150. Micro grooves 152 may have a depth of, for example, approximately 1-4 mm or a depth equal to 5% or more of the sole structure 120 thickness. In another example, micro grooves 152 may have a depth of approximately 5-12% of the sole structure 120 thickness. In general, the depth of a macro groove 151 is in general substantially greater than the depth of micro grooves 152. For instance, macro grooves 151 may have a depth that is 3-5 times larger than the depth of micro grooves 152. In another example, macro grooves 151 may have a depth that is 3 times larger than the depth of micro grooves 152. Micro grooves 152 may also have a varying depth. For example, micro grooves 152 may have a tapering structure, such that the depth of micro grooves 152 is greater at each of sides 104 and 105 than in or towards the central area of sole structure 120.

As discussed above, macro grooves 151 and micro grooves 152 operate cooperatively to enhance the flex of sole structure 120 in the areas of flexion regions 150. Given that multiple micro grooves 152 are present in specific areas of flexion regions 150, forming micro grooves 152 to have depths that are less than at least one-third the depth of macro grooves 151 imparts considerable additional flex, while retaining the structural integrity of sole structure 120 in the area of micro grooves 151.

In the configuration of sole structure 120 discussed above, portions of grooves 151 and 152 are formed in midsole 130, thereby exposing a portion of midsole 130. Given this configuration, outsole 140 includes four discrete sections, as depicted in FIG. 2, that are spaced from each other. Moreover, the sections of outsole 140 are separated by various gaps that correspond in location with flexion regions 150. In further configurations, outsole 140 may extend into depressions in midsole 130 to form the various grooves 151 and 152. In yet other configurations, outsole 140 alone may form indentations that correspond with the various grooves 151 and 152.

Based upon the above discussion, sole structure 120 includes the various flexion regions 150, which enhance the flex properties of footwear 100. Each of the flexion regions 150 include various indentations, specifically macro grooves 151 and micro grooves 152. Macro grooves 151 form relatively large indentations in sole structure 120, with micro grooves 152 forming smaller indentations in the surface of macro grooves 151. In some configurations, macro grooves 151 have depths that (a) extend through at least twenty-five percent of a thickness of sole structure 120 and (a) are at least three times the depths of micro grooves 152. Macro grooves 151 may also have greater lengths than micro grooves 152. Although macro grooves 151 exhibit greater length and depth than micro grooves 152, grooves 151 and 152 operate cooperatively to impart flex to footwear 100.

Further Configurations

The configuration of sole structure 120 discussed above and depicted in FIGS. 1-6 is intended to provide an example of a suitable structure for use in footwear 100. Various aspects of sole structure 120 may, however, vary significantly to affect the flex in footwear 100, modify other properties of footwear 100, and impart other features to footwear 100. As examples, FIGS. 7A-7C depict configurations wherein each of flexion regions 150 are modified.

Figure 7A:
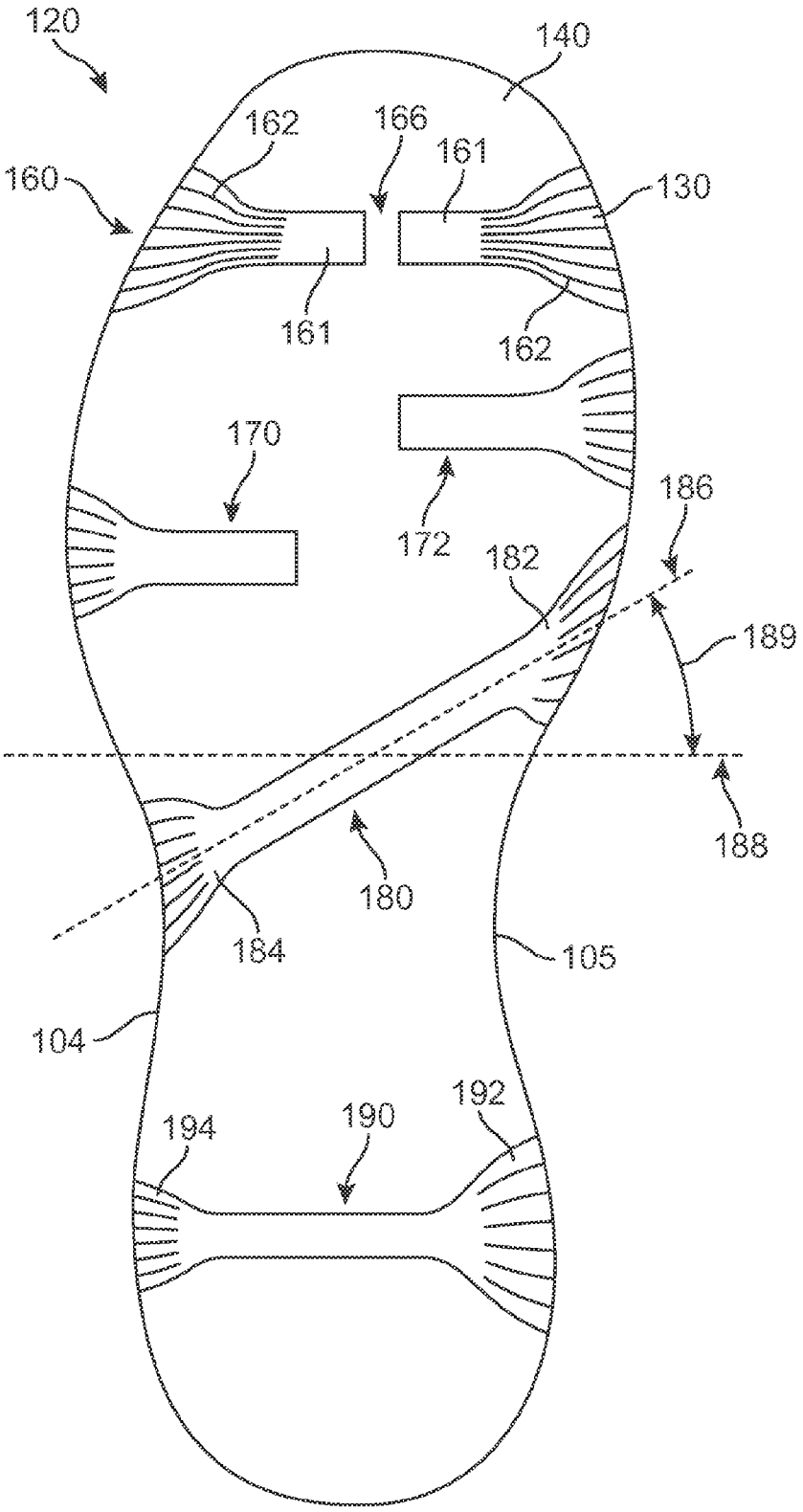
FIGS. 7A-7C are bottom plan views depicting additional configurations of the sole structure.
Figure 7B:
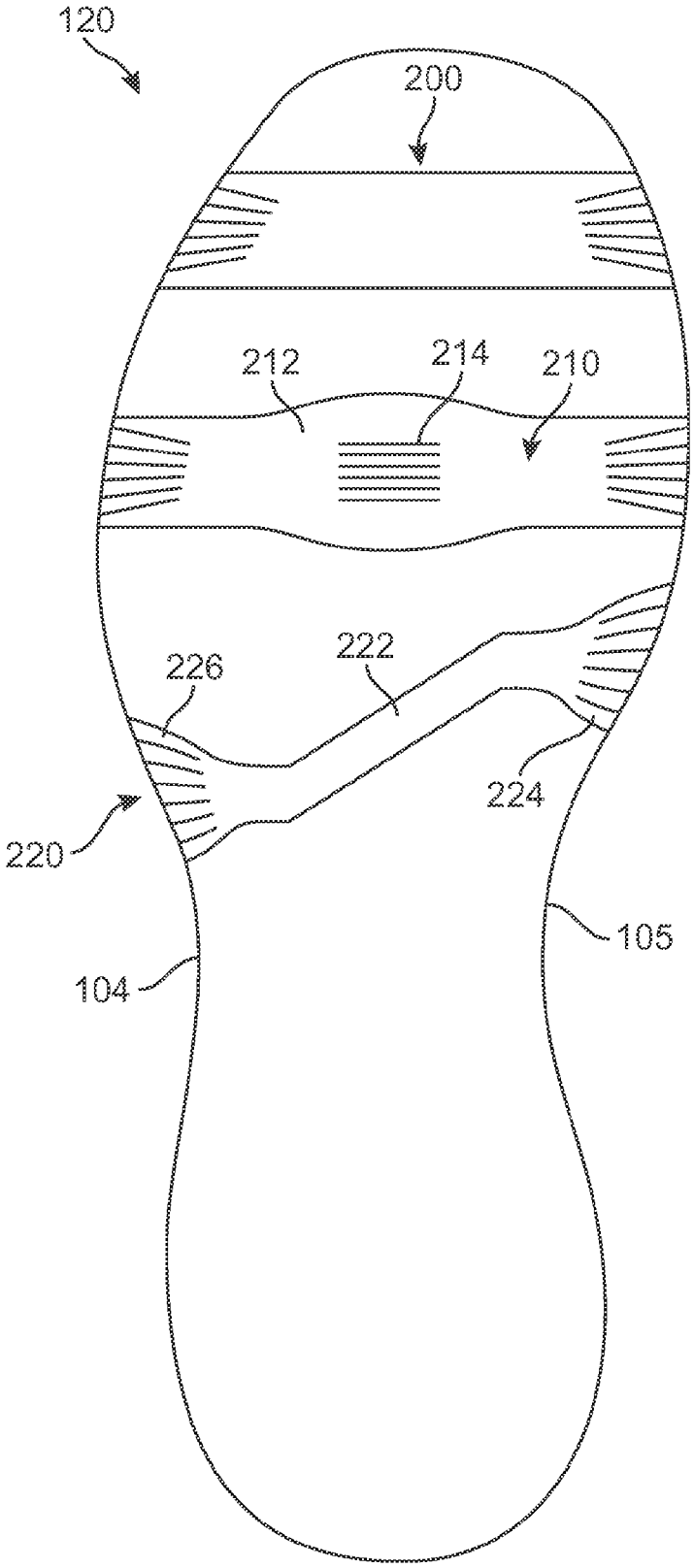
Figure 7C:
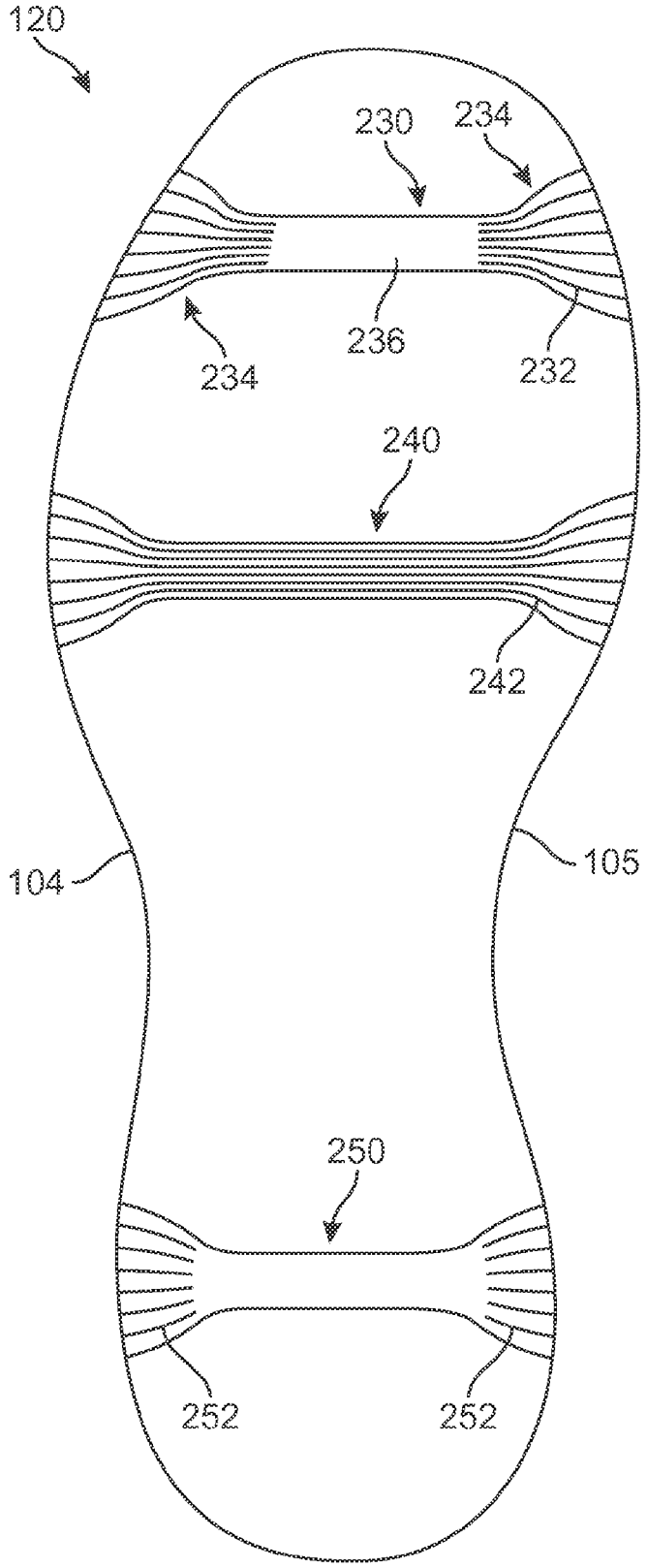

Referring to FIG. 7A, a flexion region 160, which includes a macro groove 161 and micro grooves 162, extends inward from each of sides 104 and 105, but does not extend entirely across the width of sole structure 120. That is, a portion of macro groove 161 is absent from the central area of sole structure 120, forming a gap 166 in macro groove 161. Another flexion region 170 extends from lateral side 104 to the central area, but is absent from medial side 105, thereby passing through approximately one-half of the width of sole structure 120. A similar flexion region 172 extends from medial side 105 to the central area, thereby passing through approximately one-third of the width of sole structure 120.

Whereas many of the flexion regions are substantially perpendicular to a longitudinal axis of footwear 100, FIG. 7A depicts a flexion region 180 as being angled with respect to other flexion regions. For example, medial end 182 and lateral end 184 of flexion region 180 may be located at different locations in a direction extending between a toe and heel of sole structure 120. As a result, a longitudinal axis 186 extending along flexion region 180 may be oriented at an angle 189 relative to a direction 188 extending across sole structure 120 in a medial to lateral direction. Direction 188 may be substantially perpendicular to a longitudinal axis extending between the forefoot region 101 and heel region 103 of sole structure 120. Angle 189 may be, for example, approximately 1 to 60°, or, in another example, approximately 5 to 45°. In addition, although the example of FIG. 7A depicts medial end 182 as being closer to forefoot region 101 than lateral end 184, other embodiments may be provided in which medial end 182 is closer to heel region 103 than lateral end 184.

Another flexion region 190 in FIG. 7A includes a first end 192 that is larger than a second end 194. First end 192 may be larger by extending towards forefoot region 101 and heel region 103 by a greater amount than second end 194 and/or by extending to a greater depth than second end 194. Such a configuration may be advantageous when a greater amount of flexion is desired on one side of a sole structure than another. As shown in the example of FIG. 7A, first end 192 may be located on medial side 105 and second end 194 may be located on lateral side 104. In another embodiment, first end 192 may be instead located on lateral side 104 and second end 194 may be located on medial side 105.

Referring to FIG. 7B, flexion regions of a sole structure 120 may exhibit various other configurations. For example, a flexion region 200 may include a non-tapered shape in a direction extend between sides 104, 105. In another example, flexion region 210 has a shape that has greater depth or width in the central area 212 than at either of sides 104 and 105. As shown in the example of FIG. 7B, central area 212 of flexion region 210 may include micro grooves 214, or central area 212 may lack micro grooves 214. Flexion region 220 may have an angled shape, such that central portion 222 of flexion region 220 is oriented at an angle relative to ends 224, 226. Ends 224, 226 may be oriented at the same angle relative to a medial to lateral direction across sole structure 120.

Referring to FIG. 7C, various aspects of flexion regions having modified micro groove structures are depicted. Specifically, a flexion region 230 includes micro grooves 232 that extend further toward the central area of sole structure 120. For example, micro grooves 232 may extend from tapered ends 234 of flexion region 230 and into a central area 236 of flexion region have a substantially uniform depth and/or width in a medial to lateral direction. Another flexion region 240 includes micro grooves 242 that extend entirely across sole structure 120 in a medial to lateral direction. In another flexion region 250, the number of micro grooves 252 may varies to include five micro grooves 252 adjacent to each of sides 104 and 105.

Figure 8:
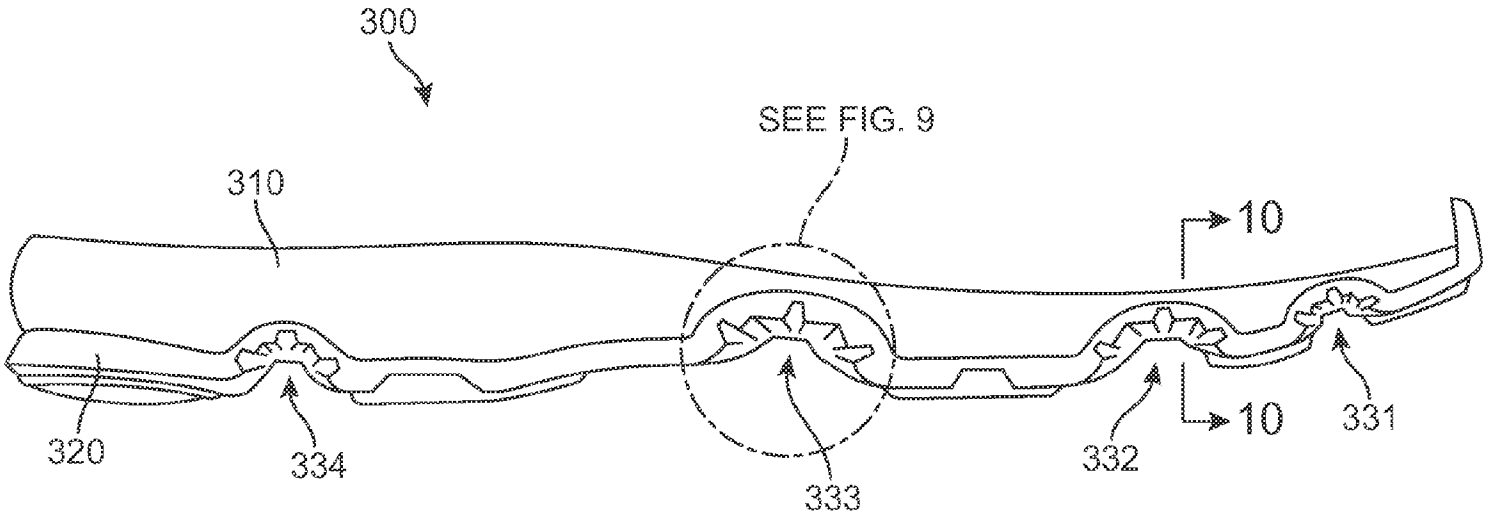
FIG. 8 is a side elevational view depicting an additional configuration of the sole structure.
Figure 9:
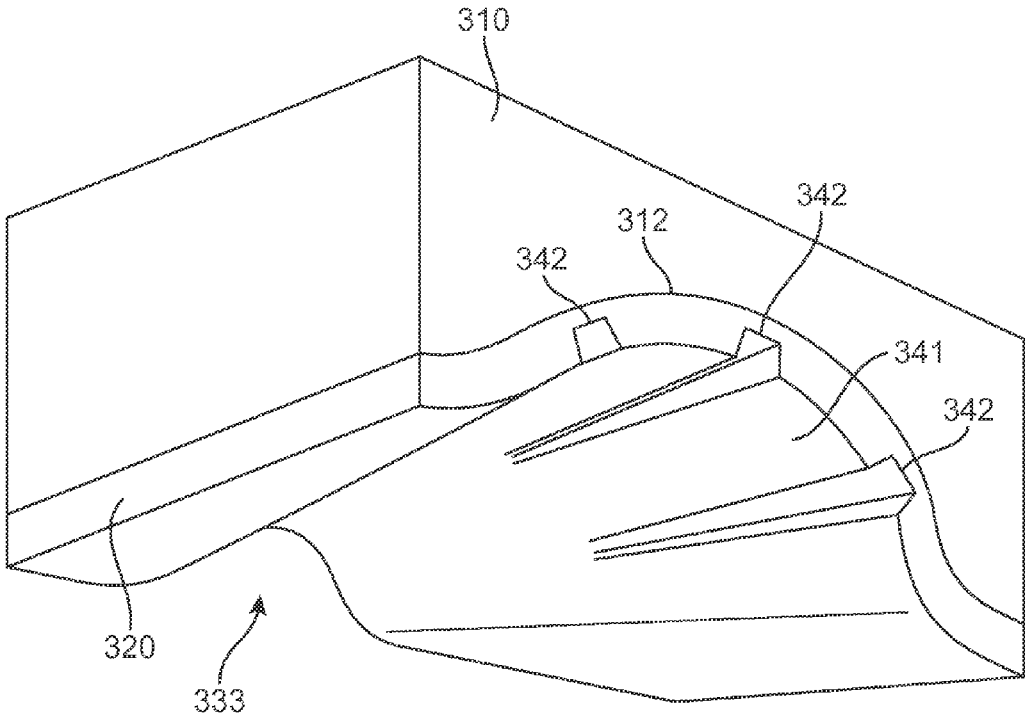
FIG. 9 is a perspective view of a portion of the sole structure, as defined in FIG. 8.
Figure 10:
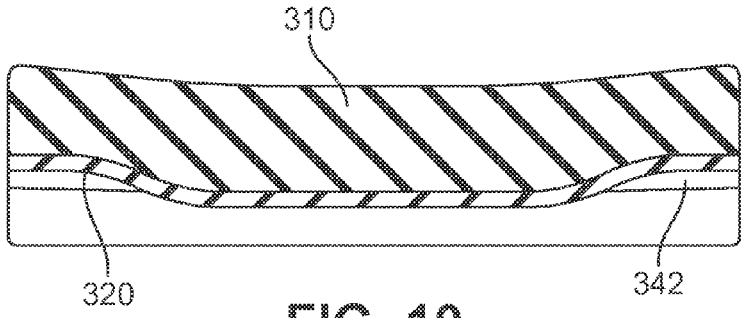
FIG. 10 is a cross-sectional view of the sole structure, as defined in FIG. 8.

Referring to FIGS. 8-10, a sole structure 300 is depicted which includes a midsole 310 and an outsole 320. Midsole 310 may be formed from a polymer foam material and outsole 320 may formed from a durable and wear-resistant rubber material that includes texturing to impart traction. As shown in FIG. 8, outsole 320 may include flexion regions 331-334. As depicted in FIG. 9, each flexion region 333 may include a macro groove 341 and micro grooves 342. Because flexion regions 331-334 are formed by outsole 320, midsole 310 includes a corresponding depression to receive each of the flexion regions 332-334. For example, midsole 310 includes depression 312 to receive macro groove 341 and micro grooves 342, as shown in FIG. 9.

Figure 11:
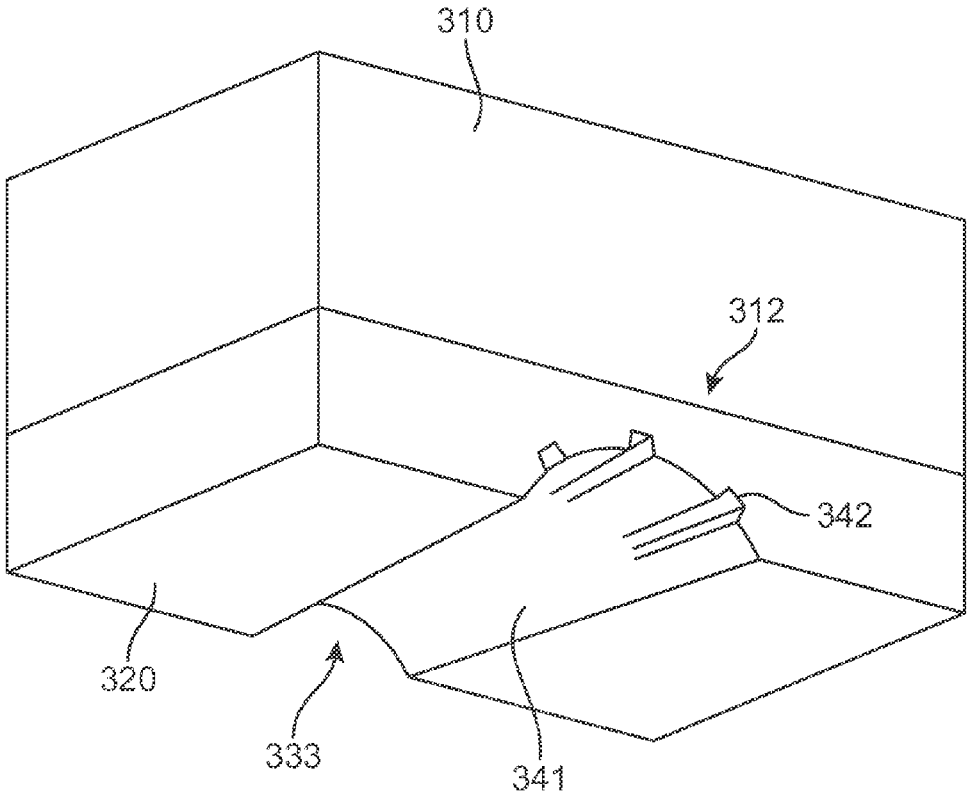
FIG. 11 is a perspective view of a portion of the sole structure, depicting an additional configuration of the sole structure.

According to an embodiment, flexion grooves may be formed in the outsole of a sole structure but the midsole may lack a depression to receive the macro groove of a flexion region. As shown in FIG. 11, outsole 320 may form flexion region 333 having macro groove 341 and micro groove 342. In contrast, midsole 310 may have a relatively flat surface 312 without any depression or shape corresponding to macro groove 341 or flexion region 333.

Figure 12:
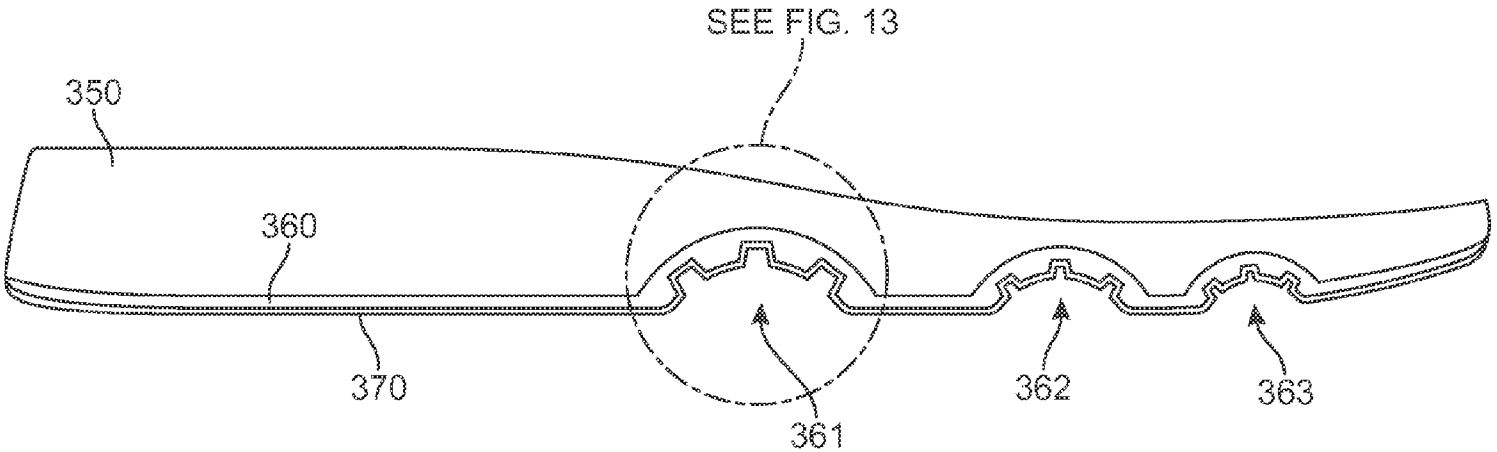
FIG. 12 is a side elevational view depicting an additional configuration of the sole structure.
Figure 13:
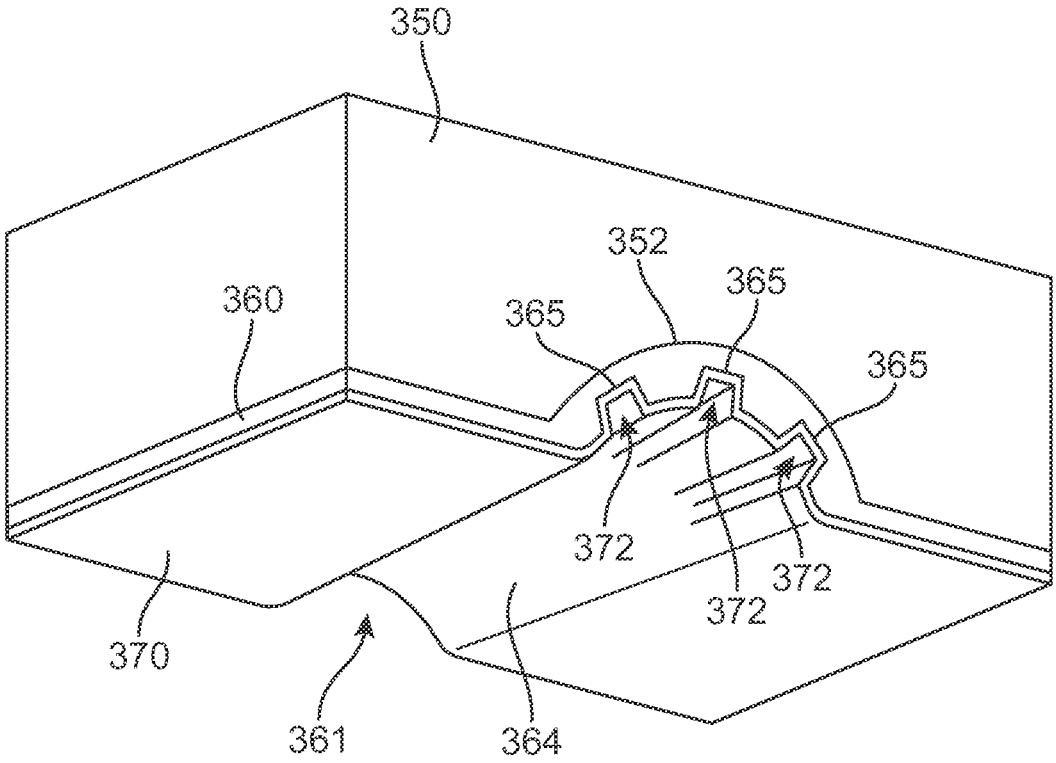
FIG. 13 is a perspective view of a portion of the sole structure, depicting an additional configuration of the sole structure.

A sole structure may include additional components or layers besides a midsole and outsole that form a shape of a groove. Turning to FIG. 12, a sole structure may include, for example, a midsole 350, an outsole 370, and an intermediate layer 360 between midsole 350 and outsole 370. Intermediate layer 360 can be, for example, a layer of foam or other material that may provide additional cushioning and/or support to the sole structure. Intermediate layer 360 may include flexion regions 361-363. As shown in FIG. 13, flexion region 361 includes a macro groove 364 and micro grooves 365. Midsole 350 includes a depression 352 to receive macro groove 364 and micro grooves 365 of flexion region 361. Outsole 370 may conform to the shape of intermediate layer 360 and include indentations 372 that extend into micro grooves 365 and otherwise conform or correspond in shape to micro grooves 365 of intermediate layer 360.

Figure 14:
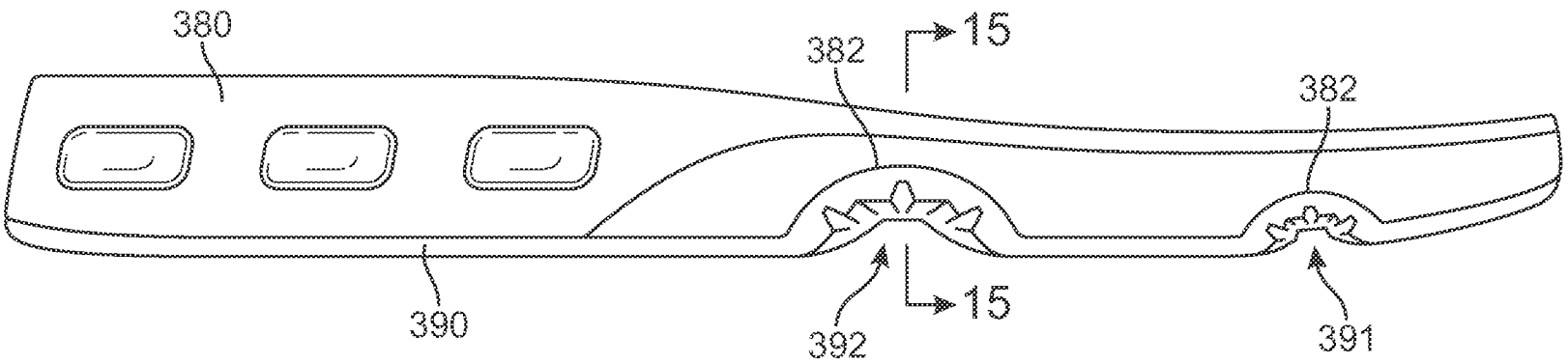
FIG. 14 is a side elevational view depicting an additional configuration of the sole structure.
Figure 15:
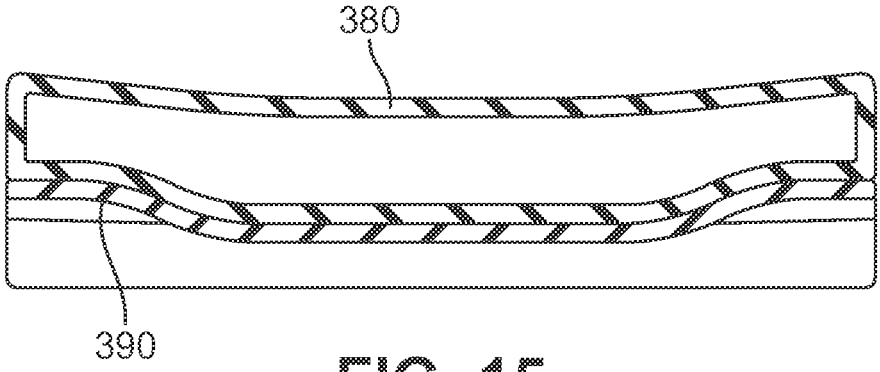
FIG. 15 is a cross-sectional view of the sole structure, as defined in FIG. 4.

According to an embodiment, the midsole of a sole structure may include or itself be a fluid-filled bladder. A fluid-filled chamber may include the features of a fluid-filled bladder described in U.S. Pat. No. 7,141,131, which is hereby incorporated by reference in its entirety. Turning to FIG. 14, a sole structure may be provided that includes a fluid-filled bladder 380 and an outsole 390. Outsole 390 includes flexion regions 391, 392 having the features of the embodiments described herein. Fluid-filled bladder 380 includes a depression 382 in its bottom surface that faces a ground surface to receive flexion regions 391, 392.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear comprising an upper and a sole structure secured to the upper, the sole structure extending through a length of the footwear and from a lateral side to an opposite medial side of the footwear, and the sole structure defining a first surface and an opposite second surface, the first surface being joined to the upper, and the second surface forming a ground-contacting area of the footwear that defines:

a macro groove having (a) a length extending from the lateral side and toward the medial side and (b) a depth extending into the sole structure and toward the first surface; and a plurality of micro grooves located within the macro groove, the micro grooves having (a) lengths extending from the lateral side and toward the medial side and (b) depths extending into the sole structure and toward the first surface, the length of the macro groove being greater than the lengths of the micro grooves, and the depth of the macro groove being at least three times the depths of the micro grooves.

2. The article of footwear recited in claim 1, wherein the macro groove extends from the lateral side to at least a central area of the second surface.

3. The article of footwear recited in claim 2, wherein the depth of the macro groove is greater at the lateral side than in the central area.

4. The article of footwear recited in claim 2, wherein the micro grooves are absent from the central area.

5. The article of footwear recited in claim 1, wherein the macro groove extends from the lateral side to the medial side.

6. The article of footwear recited in claim 5, wherein the depth of the macro groove is greater at the lateral side and the medial side than in the central area.

7. The article of footwear recited in claim 5, wherein the micro grooves are absent from the central area, and a plurality of additional micro grooves are located within the macro groove and at the medial side.

8. The article of footwear recited in claim 1, wherein the depth of the macro groove at the lateral side extends through at least twenty-five percent of a distance between the first surface and the second surface.

9. The article of footwear recited in claim 1, wherein the sole structure includes a midsole and an outsole, the macro groove and the micro grooves being formed in the midsole, and the outsole being absent in an area of the macro groove and the micro grooves.

10. The article of footwear recited in claim 1, wherein the sole structure includes a midsole and an outsole, the midsole defining the first surface and a depression located opposite the first surface, and the outsole forming the second surface and extending into the depression.

11. The article of footwear recited in claim 1, wherein the sole structure includes a midsole and an outsole, the midsole being a fluid-filled chamber, and the outsole being secured to the midsole.

12. The article of footwear recited in claim 1, wherein the micro grooves have a depth of approximately 5-12% of a thickness of the sole structure.

13. An article of footwear comprising an upper and a sole structure secured to the upper, the sole structure having a ground-contacting surface that defines a plurality of macro grooves extending from opposite sides of the footwear and toward a central area of the footwear, at least one of the macro grooves having (a) a depth that is greater at the sides of the footwear than in the central area and (b) a plurality of micro grooves located adjacent to the sides of the footwear and extending toward the central area, each of the macro grooves and the micro grooves being indentations in the ground-contacting surface that extend into the sole structure.

14. The article of footwear recited in claim 13, wherein the micro grooves are absent from the central area.

15. The article of footwear recited in claim 13, wherein lengths of the macro grooves are greater than lengths of the micro grooves.

16. The article of footwear recited in claim 13, wherein the depth at the sides of the footwear is at least three times depths of the micro grooves at the sides of the footwear.

17. The article of footwear recited in claim 13, wherein the depth at the sides of the footwear extends through at least twenty-five percent of a thickness of the sole structure.

18. The article of footwear recited in claim 13, wherein the micro grooves have a depth of approximately 5-12% of a thickness of the sole structure.

19. The article of footwear recited in claim 13, wherein the sole structure includes a midsole and an outsole, the macro grooves and the micro grooves being formed in the midsole, and the outsole being absent in areas of the macro grooves and the micro grooves.

20. The article of footwear recited in claim 13, wherein the sole structure includes a midsole and an outsole, a lower surface of the midsole defines a plurality of depressions in areas of the macro grooves, and the outsole forms the ground-contact surface and extends into the depressions of the midsole to form the macro grooves.

21. The article of footwear recited in claim 13, wherein the macro grooves have a depth of approximately 3-5 times a depth of the micro grooves.

22. The article of footwear recited in claim 13, wherein the sole structure includes a midsole and an outsole, the midsole being a fluid-filled chamber, and the outsole being secured to the midsole.

23. An article of footwear comprising an upper and a sole structure secured to the upper, the sole structure having an upper surface and an opposite ground-contacting surface that defines:

a first indentation having a first length and a first depth; and a plurality of second indentations located within the first indentation, each of the second indentations having a second length and a second depth, the first length being greater than the second length, the first depth being at least three times the second depth, and the first depth being at least twenty-five percent of a distance between the upper surface and the ground-contacting surface.

24. The article of footwear recited in claim 23, wherein the first indentation extends between opposite sides of the footwear.

25. The article of footwear recited in claim 23, wherein the first indentation is absent from at least a portion of a central area of the footwear.

26. The article of footwear recited in claim 23, wherein the first depth is greater at a side of the footwear than in a central area of the footwear.

27. The article of footwear recited in claim 23, wherein the second indentations are (a) located adjacent to at least one side of the footwear and (b) absent from a central area of the footwear.

28. The article of footwear recited in claim 23, wherein the sole structure includes a midsole and an outsole, the first indentation and the second indentation being formed in the midsole, and the outsole being absent in an area of the first indentation and the second indentation.

29. The article of footwear recited in claim 23, wherein the sole structure includes a midsole and an outsole, the midsole defining a depression located at the first indentation, and the outsole forming the ground-contacting surface and extending into the depression.

30. The article of footwear recited in claim 23, wherein the sole structure includes a midsole and an outsole, the midsole being a fluid-filled chamber, and the outsole being secured to the midsole.

31. An article of footwear having an upper and a sole structure secured to the upper, the sole structure comprising:

a midsole having a first surface and a second surface, the first surface being located adjacent to the upper, and the second surface being located opposite the first surface and defining a depression that extends in a direction between opposite sides of the footwear;

an outsole secured to at least a portion of the second surface, the outsole forming at least a portion of a ground-contacting surface of the footwear;

a macro groove located at the depression and extending in the direction between the opposite sides of the footwear, the macro groove forming an indentation in the ground-contacting surface; and a plurality of micro grooves located within the macro groove, the micro grooves extending in the direction between the opposite sides of the footwear, and the micro grooves forming additional indentations in the ground-contacting surface.

32. The article of footwear recited in claim 31, wherein the outsole is absent in an area of the depression and exposes a portion of the second surface that defines the depression, the portion of the second surface that defines the depression forms an area of the ground-contacting surface, and the micro grooves are formed in the second surface.

33. The article of footwear recited in claim 31, wherein the outsole extends into the depression to form the macro groove.

34. The article of footwear recited in claim 31, wherein the midsole is a fluid-filled chamber.

* * * * *